US011932460B2

(12) United States Patent
Fox et al.

(10) Patent No.: US 11,932,460 B2
(45) Date of Patent: Mar. 19, 2024

(54) CLOSURE

(71) Applicant: Obrist Closures Switzerland GmbH, Reinach (CH)

(72) Inventors: Jamie Fox, Norfolk (GB); Thomas Cox, Norwich (GB)

(73) Assignee: Obrist Closures Switzerland GmbH, Reinach (CH)

( * ) Notice: Subject to any disclaimer, the term of this patent is extended or adjusted under 35 U.S.C. 154(b) by 34 days.

(21) Appl. No.: 17/634,110

(22) PCT Filed: Aug. 15, 2020

(86) PCT No.: PCT/EP2020/072940

§ 371 (c)(1),
(2) Date: Feb. 9, 2022

(87) PCT Pub. No.: WO2021/032651

PCT Pub. Date: Feb. 25, 2021

(65) Prior Publication Data

US 2022/0363451 A1 Nov. 17, 2022

(30) Foreign Application Priority Data

| | | |
|---|---|---|
| Aug. 18, 2019 | (GB) | 1911834 |
| Sep. 5, 2019 | (GB) | 1912798 |
| Dec. 9, 2019 | (GB) | 1917984 |

(51) Int. Cl.
*B65D 47/08* (2006.01)
*B65D 47/10* (2006.01)

(52) U.S. Cl.
CPC ..... *B65D 47/10* (2013.01); *B65D 47/0804* (2013.01); *B65D 47/0809* (2013.01); *B65D 2401/20* (2020.05)

(58) Field of Classification Search
CPC ..... B65D 47/10; B65D 47/0804; B65D 2401/20; B65D 47/0809
See application file for complete search history.

(56) References Cited

U.S. PATENT DOCUMENTS 3,655,099 A * 4/1972 Hazard ..... B65D 47/305 222/536
4,651,885 A * 3/1987 Gach ..... B65D 55/02 215/250

(Continued)

FOREIGN PATENT DOCUMENTS

DE 29512523 U1 10/1995
EP 0141591 A2 5/1985

(Continued)

OTHER PUBLICATIONS

Nov. 20, 2020—(WO) International Search Report and Written Opinion—Appl. No. PCT/EP2020/072940, 9 pages.

(Continued)

*Primary Examiner* — Frederick C Nicolas
(74) *Attorney, Agent, or Firm* — Banner & Witcoff, Ltd.

(57) ABSTRACT

A tamper-evident closure is provided and includes a base and a lid. The lid is movable between a closed and an open position with respect to the base. The closure includes a tamper-evident member which is initially provided on or by the base with the closure in an unopened condition. The tamper-evident member is released from the base when the lid is initially moved to the open position and is then retained by the lid.

18 Claims, 12 Drawing Sheets

(56) References Cited

U.S. PATENT DOCUMENTS

| | | | | |
|---|---|---|---|---|
| 4,782,964 | A | 11/1988 | Poore et al. | |
| 6,976,607 | B2 * | 12/2005 | Benoit-Gonin .... | B65D 47/0838 222/153.14 |
| 7,810,663 | B2 * | 10/2010 | Young ..... | B65D 47/0804 215/253 |

FOREIGN PATENT DOCUMENTS

| | | | |
|---|---|---|---|
| EP | 2114788 | B1 | 3/2014 |
| FR | 2707958 | A1 | 1/1995 |
| FR | 2820120 | A1 | 8/2002 |
| WO | 02060776 | A1 | 8/2002 |

OTHER PUBLICATIONS

Mar. 31, 2022—(EP)—Thrid Party Observation—App. No. 20758155.4.

Jun. 21, 2002—(WO)—International Search Report—App. No. PCT/EP02/00949.

* cited by examiner

CLOSURE

CROSS-REFERENCE TO RELATED APPLICATIONS

This application is a U.S. National Stage application under 35 U.S.C. § 371 of International Application PCT/EP2020/072940 (published as WO 2021/032651), filed Aug. 15, 2020, which claims the benefit of priority to U.K. Application No. 1911834.8, filed Aug. 18, 2019, U.K. Application No. 1912798.4, filed Sep. 5, 2019, and U.K. Application No. 1917984.5, filed Dec. 9, 2019. Each of these prior applications is hereby incorporated by reference in its entirety.

The present invention relates generally to a closure and particularly to a tamper-evident closure, such as a tamper-evident flip-top dispensing closure.

An aspect of the present invention provides a tamper-evident closure comprising a base and a lid, the lid is movable between a closed and an open position with respect to the base, the closure comprises a tamper-evident member which is initially provided on or by the base with the closure in an unopened condition, in which the tamper-evident member is released from the base when the lid is initially moved to the open position and is then retained by the lid.

The tamper-evident member may be frangibly connected to the base and may be configured to break away from the base upon first opening.

In aspects and embodiments of the present invention a lid may include "pockets" (recesses/slots or the like) formed to help retain the ends of the strip and into which the ends fit when then closure is assembled (e.g. when closed for the first time after moulding). In some embodiments the pockets may be formed by overhangs, for example extensions of a lid sidewall.

The lid may include one or more pockets, recesses, slots or the like for retaining the tamper-evident member.

The or each pocket, recess, slot or the like may be formed by an overhang.

The or each pocket, recess, slot or the like may be formed by an extension of a lid sidewall.

The pockets may include a bead or the like and the ends of the strip may include a corresponding bead to help retain the strip (stopping it from being pulled/slid out of the pockets).

Pockets, recesses, slots or the like may be provided to retain ends of the tamper-evident member and into which said ends may fit when the closure is assembled.

The or each pocket, recess, slot or the like may include a bead or the like to help retain the tamper-evident member. The tamper-evident member may include corresponding bead/s.

The tamper-evident member may comprise one or more cut-out portions.

The lid may comprise one or more lifting lugs/projections.

The lifting lugs/projections may be positioned in a recessed zone. The recessed zone may be located at the front of the closure, for example generally opposite a hinge.

The lugs may lift/pull the tamper-evident member away from the base when the lid is initially opened.

The lugs/projections may fit under/into cut-outs formed in the tamper-evident member.

The tamper-evident member may be a tamper-evident strip.

The base and lid may be joined by a hinge so that the lid can move between the closed and open positions.

The base may comprise a dispensing orifice.

The base may comprise a top deck and the orifice may be provided in the deck.

The orifice may be generally in the centre of the deck.

The deck may be a generally circular plate.

The orifice may be defined by an upstanding spout.

The closure may be formed by moulding, for example injection moulding.

The closure may be formed in an open position.

In some aspects and embodiments a tamper-evident strip is provided and is configured to break away from the base upon opening, but has the additional function of the strip/band being retained in the lid after first opening.

The closure may comprise a base and lid.

The base and lid may be connected by a hinge so that the lid can move between a closed and an open position.

The base may comprise a dispensing orifice. For example the base may comprises a top deck and an orifice is provided in the deck, for example generally in the centre of the deck. The orifice may be defined by an upstanding spout.

The closure may be provided with a tamper-evident strip.

The strip may be provided on or by the base and may be frangibly connected to the base.

The strip may be connected to the base by one or more frangible bridges.

The strip may have one or more cut-out portions.

The lid may comprise one or more lifting lugs/projections. The lugs may be positioned in a recessed zone, for example at the "front" of the closure (e.g. opposite a hinge).

The lugs may lift/pull the strip away from the base in use, causing frangible bridges to break. The lugs may fit under/into cut-outs formed in a strip.

The closure may be formed, for example, by moulding. The strip may be formed as part of the base.

The closure may be formed in an open position.

A further aspect provides a tethered tamper-evident flip-top dispensing closure comprising a snap-on base and a lid connected to the base by a hinge, a tamper-evident strip is frangibly connected to the base, the lid includes means for causing the strip to break away from the base when it is first opened, and the lid include means for retaining the strip thereafter.

Different aspects and embodiments of the invention may be used separately or together.

Further particular and preferred aspects of the present invention are set out in the accompanying independent and dependent claims. Features of the dependent claims may be combined with the features of the independent claims as appropriate, and in combination other than those explicitly set out in the claims. Each aspect can be carried out independently of the other aspects or in combination with one or more of the other aspects.

The present invention will now be more particularly described, by way of example, with reference to the accompanying drawings, in which.

Figure 2:
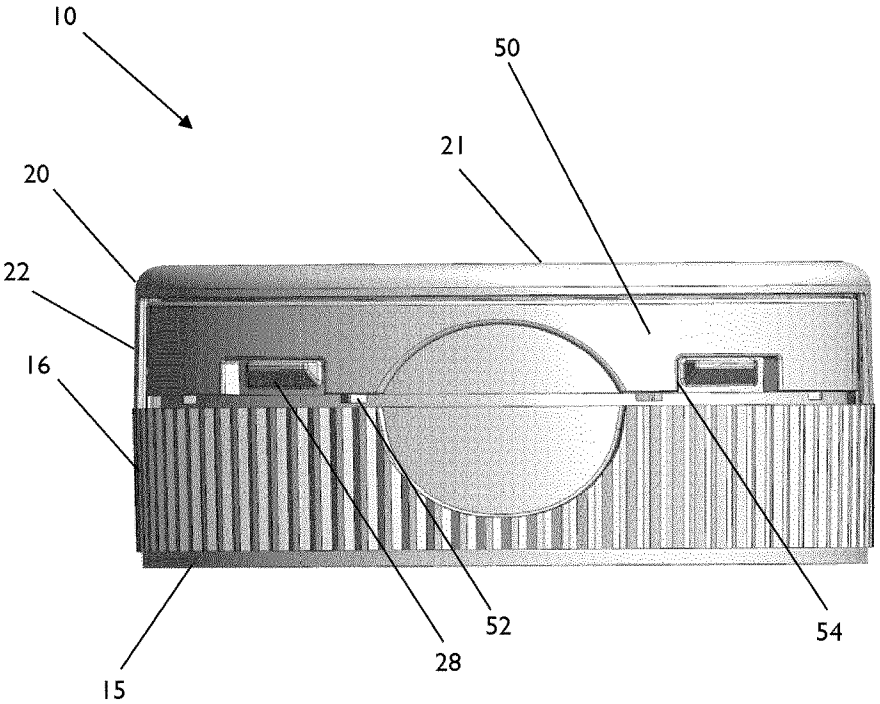
FIG. 2 is a front view of the closure of FIG. 1.
Figure 1:
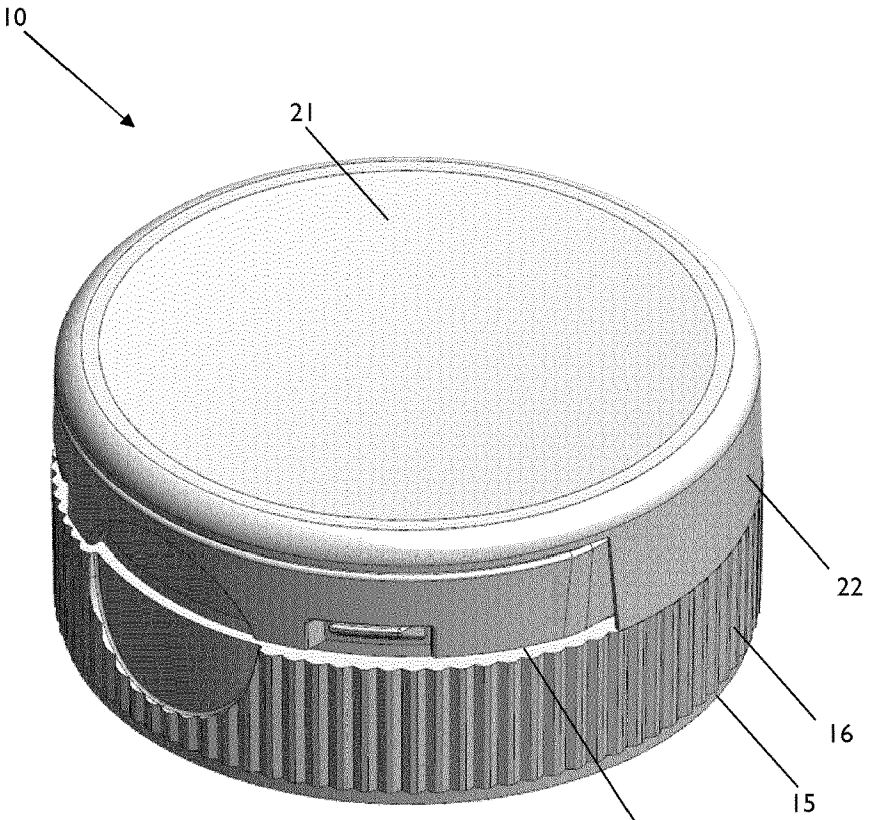
FIG. 1 is perspective view of a closure formed in accordance with an embodiment of the present invention and shown in a closed, unopened position.

The example embodiments are described in sufficient detail to enable those of ordinary skill in the art to embody and implement the systems and processes herein described. It is important to understand that embodiments can be provided in many alternative forms and should not be construed as limited to the examples set forth herein.

Accordingly, while embodiments can be modified in various ways and take on various alternative forms, specific embodiments thereof are shown in the drawings and described in detail below as examples. There is no intent to limit to the particular forms disclosed. On the contrary, all modifications, equivalents, and alternatives falling within the scope of the appended claims should be included. Elements of the example embodiments are consistently denoted by the same reference numerals throughout the drawings and detailed description where appropriate.

Unless otherwise defined, all terms (including technical and scientific terms) used herein are to be interpreted as is customary in the art. It will be further understood that terms in common usage should also be interpreted as is customary in the relevant art and not in an idealised or overly formal sense unless expressly so defined herein.

In the following description, all orientational terms, such as upper, lower, radially and axially, are used in relation to the drawings and should not be interpreted as limiting on the invention.

Referring first to FIGS. 1 to 12 there is shown a tamper-evident closure generally indicated 10.

Figure 4:
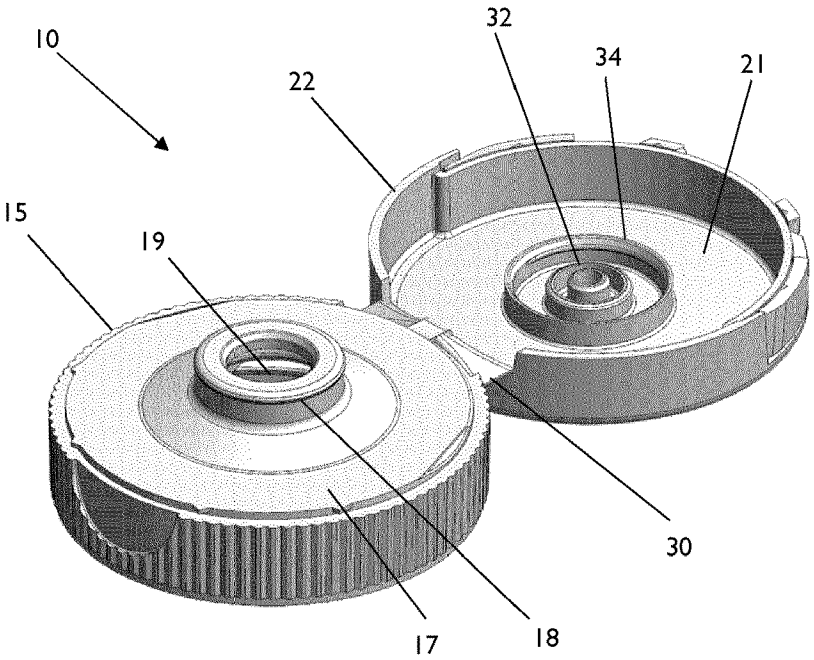
FIG. 4 shows the closure of FIGS. 1 to 3 in an open position.
Figure 3:
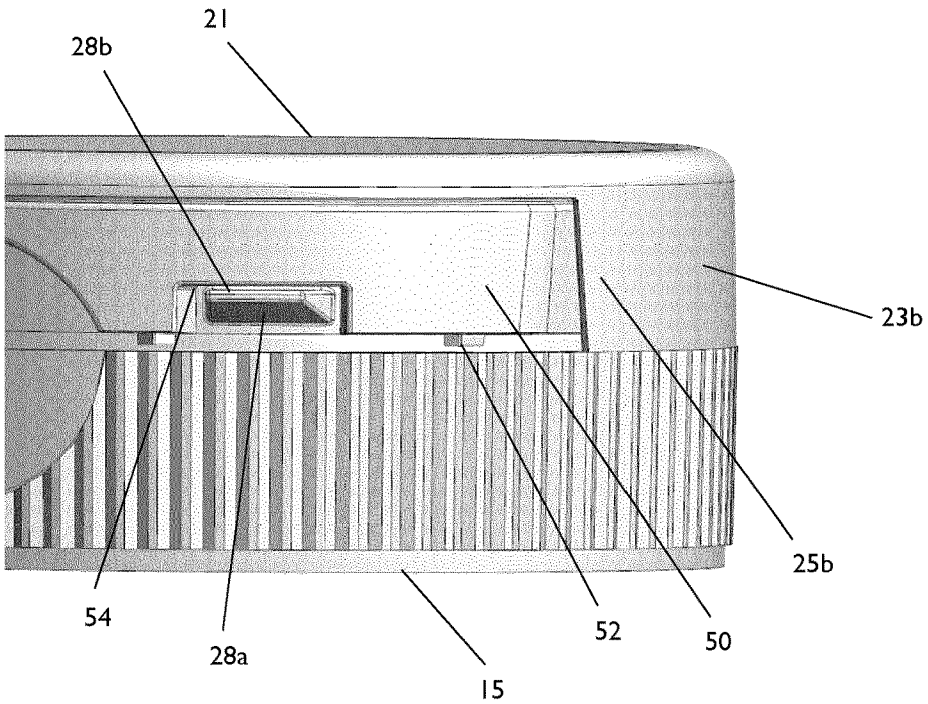
FIG. 3 is a magnified view of one side of the front view of FIG. 2.
Figure 6:
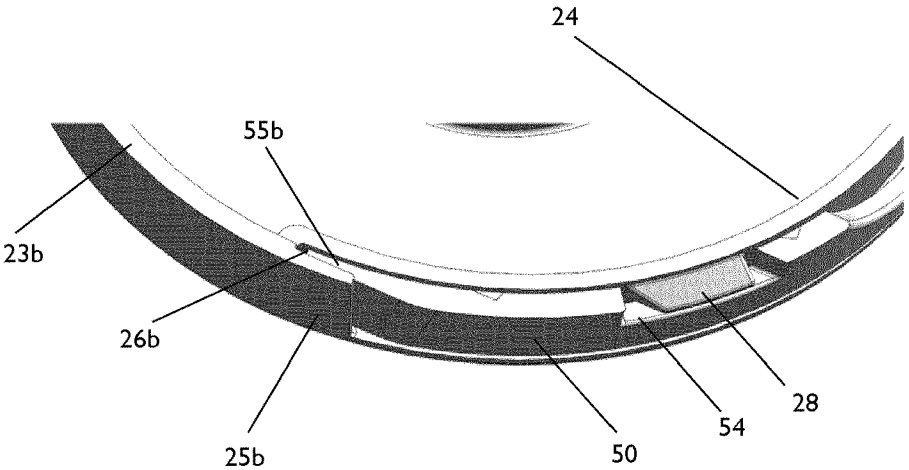
FIG. 6 is a magnified view of the front of the lid if FIG. 5 showing a retained tamper-evident strip.
Figure 5:
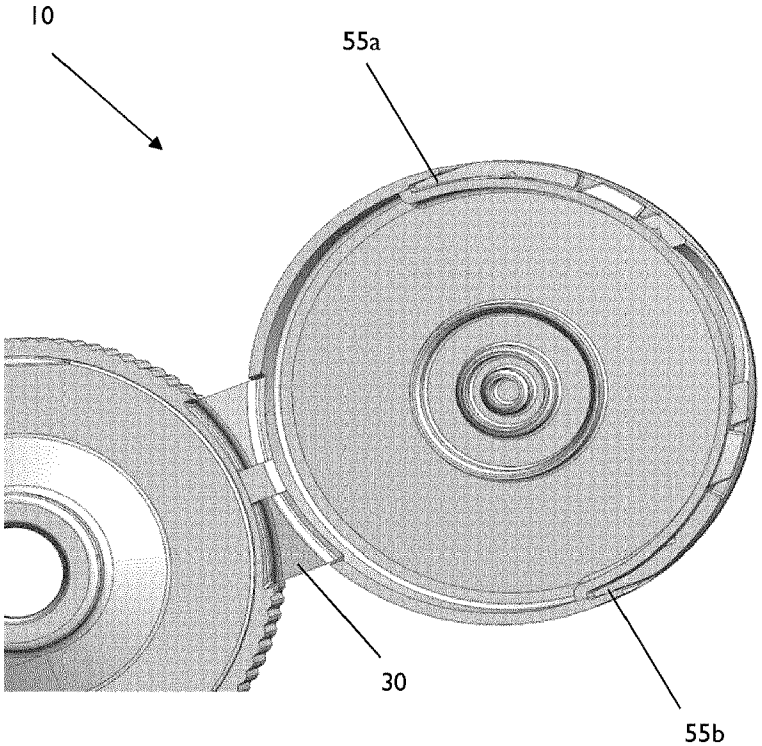
FIG. 5 shows the underside of the lid of FIG. 4.

The closure 10 comprises a base 15 and a lid 20 joined together by a hinge 30 so that the lid can move between closed position (e.g. FIG. 1) and an open position (e.g. FIG. 4).

The base 15 comprises a generally cylindrical sidewall 16 closed at one end by a top deck 17. At the centre of the top deck 17 a dispensing spout 18 is provided to define a dispensing orifice 19. In this embodiment the base is formed so as to be "snap-on" i.e. an internal snap bead (not shown) is provided for engaging a corresponding bead on a container with the intention that the base cannot (easily) be removed after initial application.

The lid 20 comprises a generally circular top plate 21 at the periphery of which is a depending cylindrical skirt 22.

Inner 32 and outer 34 sealing skirts depend from the underside of the lid top plate 21 for sealing the spout 18.

The skirt 22 comprises two arcuate wall sections 23*a*, 23*b* which extend from the hinge region. The wall sections 23*a*, 23*b* are joined by an arcuate recessed wall section 24 which extends around the front of the closure, opposite the hinge.

It will be noted (see e.g. FIGS. 6 and 8) that, circumferentially, the wall sections 23*a*, 23*b* continue beyond the ends of the recessed wall section 24, forming wall extension portions 25*a*, 25*b* that define pockets or slots 26*a*, 26*b*.

Figure 11:
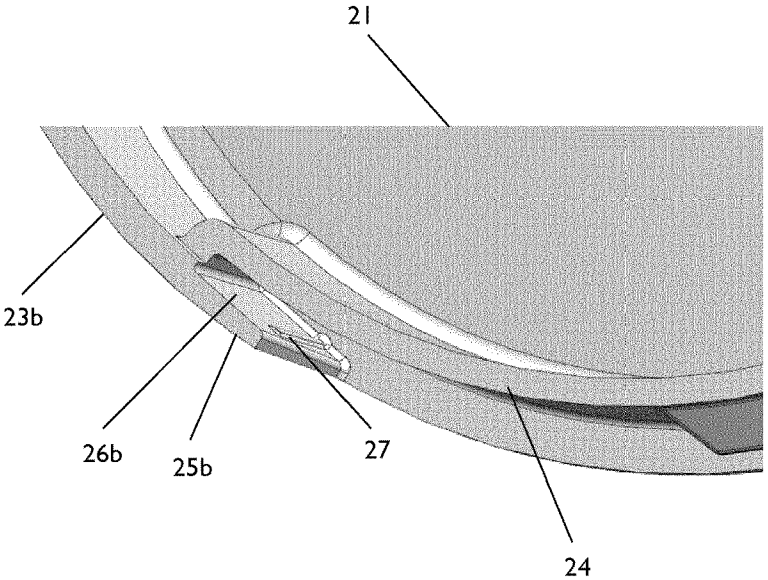
FIG. 11 is a further magnified view of a strip retention region of the lid of FIG. 10.

As shown best in FIG. 11 the interior of the wall extension portions 25*a*, 25*b* are provided with an axial bead/rib 27.

An arcuate tamper-evident strip 50 is provided at the "front" of the closure.

The strip 50 is frangibly connected to the top of the periphery of the base by frangible bridge 52.

Figure 8:
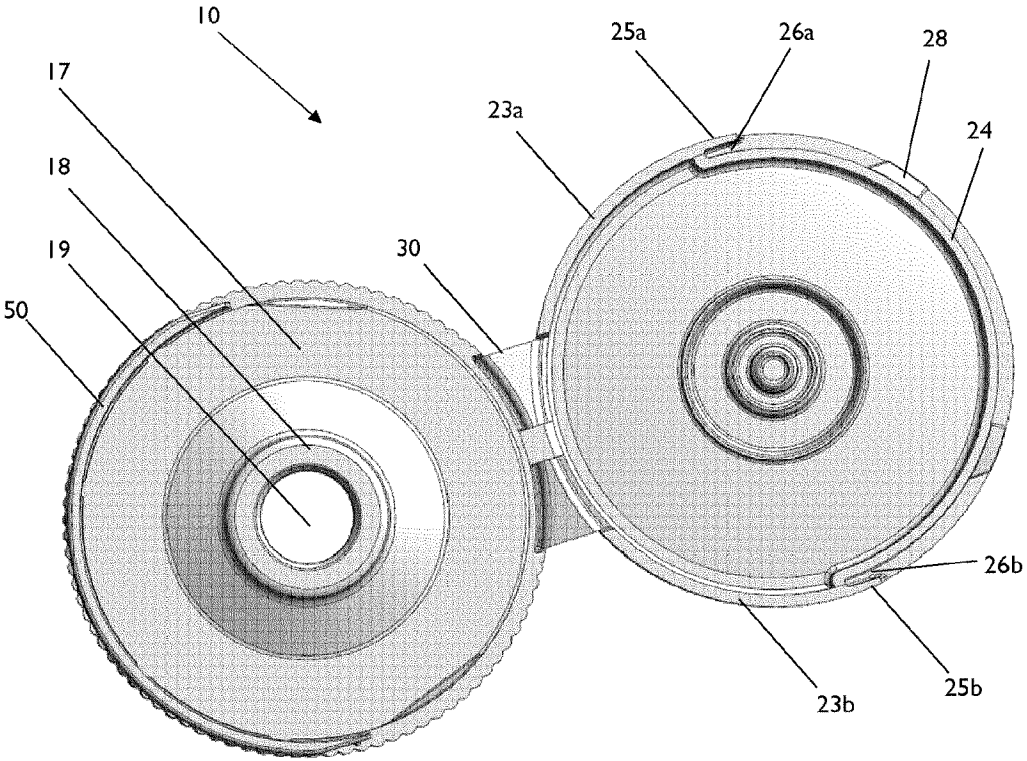
FIG. 8 is a plan view of the closure of FIG. 7.
Figure 7:
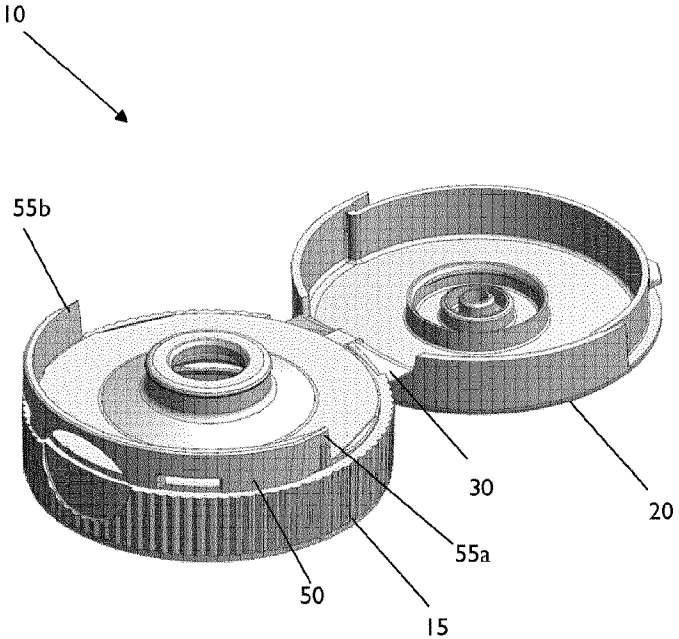
FIG. 7 shows the closure of FIGS. 1 to 6 in an as-moulded condition.
Figure 10:
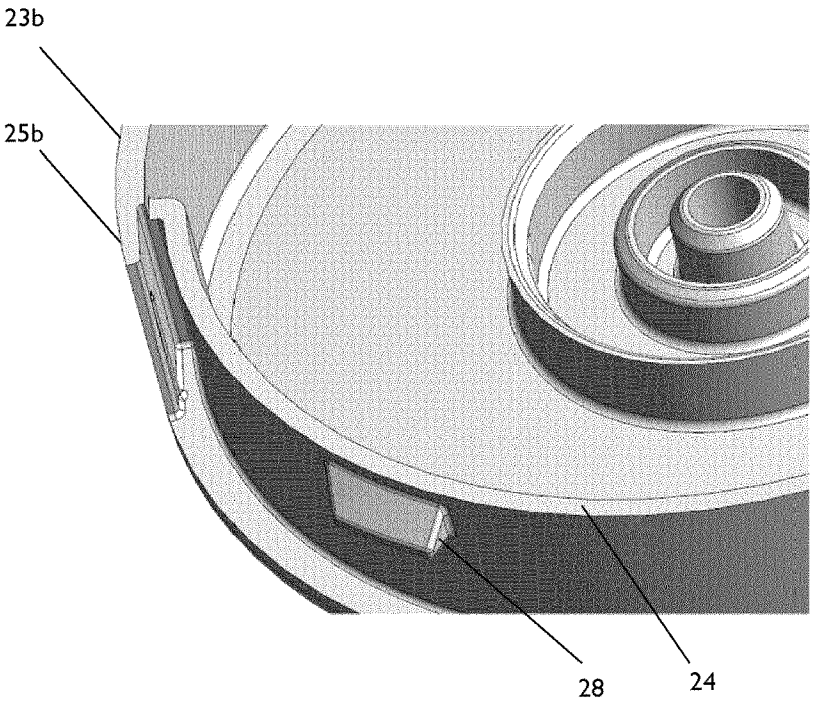
FIG. 10 is a magnified view of the underside of part of the lid of the closure of FIGS. 7 to 9.
Figure 9:
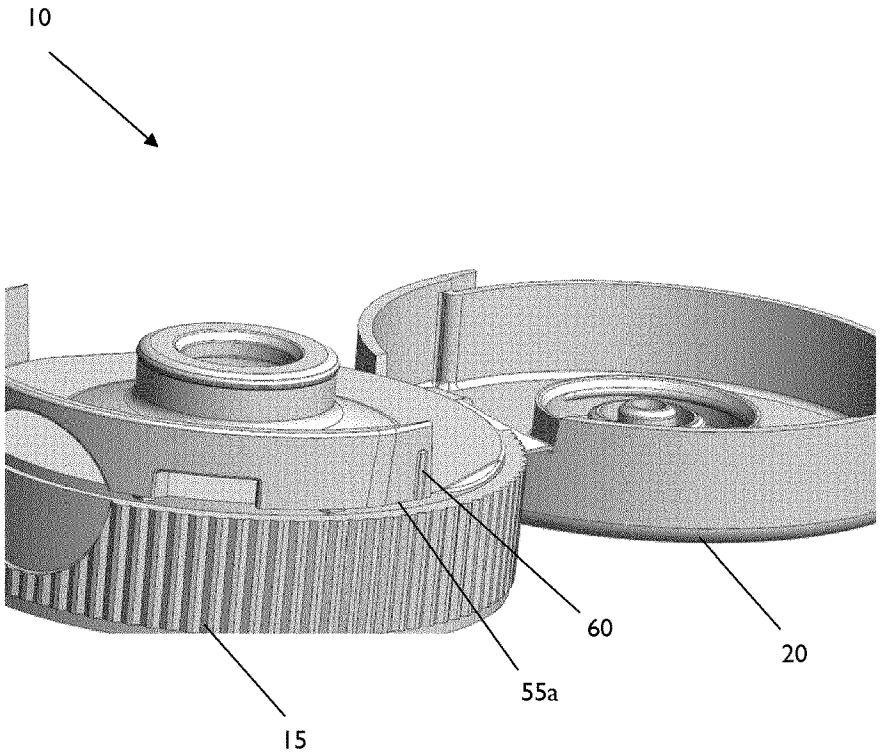
FIG. 9 is a front perspective view of the closure of FIGS. 7 and 8.
Figure 12:
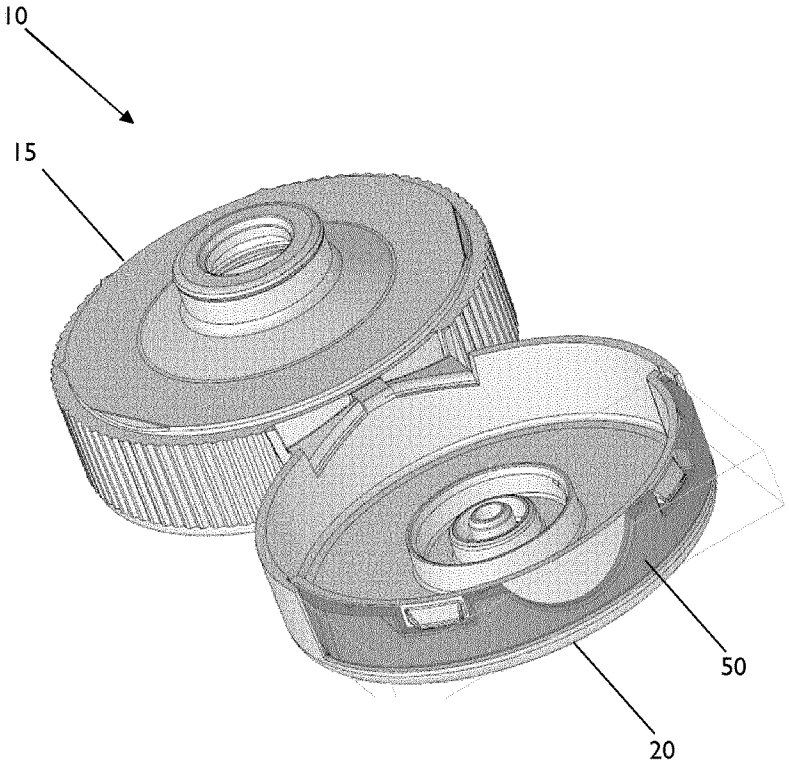
FIG. 12 is a rear perspective view of the closure of FIGS. 1 to 11 and shown in an open position with a tamper-evident strip retained by a lid.

FIGS. 7 to 9 show the base in an as-formed (moulded) condition with the strip attached.

The recessed wall section 24 of the lid is provided with two wedge-like projections/lugs 28. The projections 28 include an inclined lower surface 28*a* and a flat upper surface 28*b*.

The strip 50 is provided with two notches 54 which correspond with the projections 28. The ends 55*a*, 55*b* of the strip 50 fit into respective lid pockets 26*a*, 26*b*. In this embodiment the strip ends 55*a*, 55*b* are provided with retention beads 60 that correspond with the extension portion beads 27, which helps to retain the strip (stopping it from being pulled/slid out of the lid pockets).

When the closure is assembled from the as-formed condition (FIGS. 7 to 9) to the initially closed position (FIGS. 1 and 2) the inclined lower surfaces 28*a* allow the projections to slide behind the strip and come to rest in the notches 54. The flat upper surfaces 28*b* prevent the lid from being lifted without lifting the strip, breaking it away from the base. The strip is retained by the lid (see FIGS. 4 to 6 and 12) by virtue of the engagement of the strip ends in the lid pockets in combination with the engagement of the lid projections under the strip notches.

Figure 13:
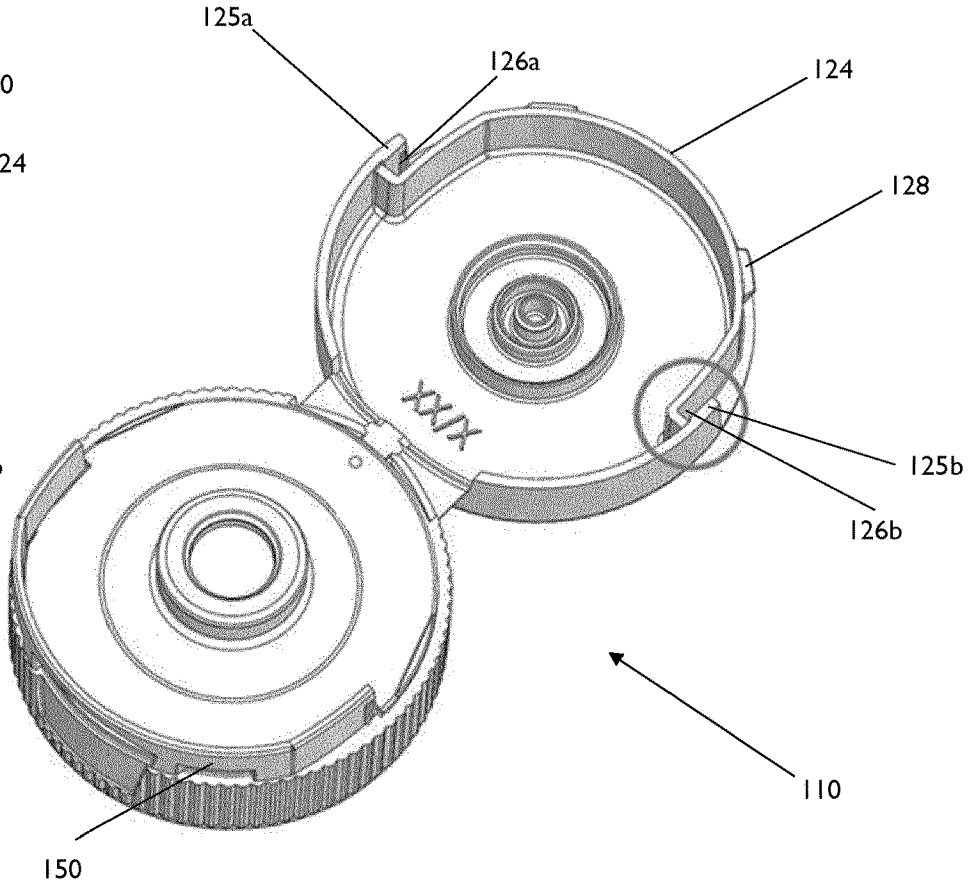
FIG. 13 is a perspective view of a closure formed according to a further embodiment and shown in an as-moulded condition.

FIG. 13 shows a closure 110 (shown in an as moulded condition) generally similar to the closure 10 and having closed-ended strip retention pockets 126*a*, 126*b*.

Figure 14:
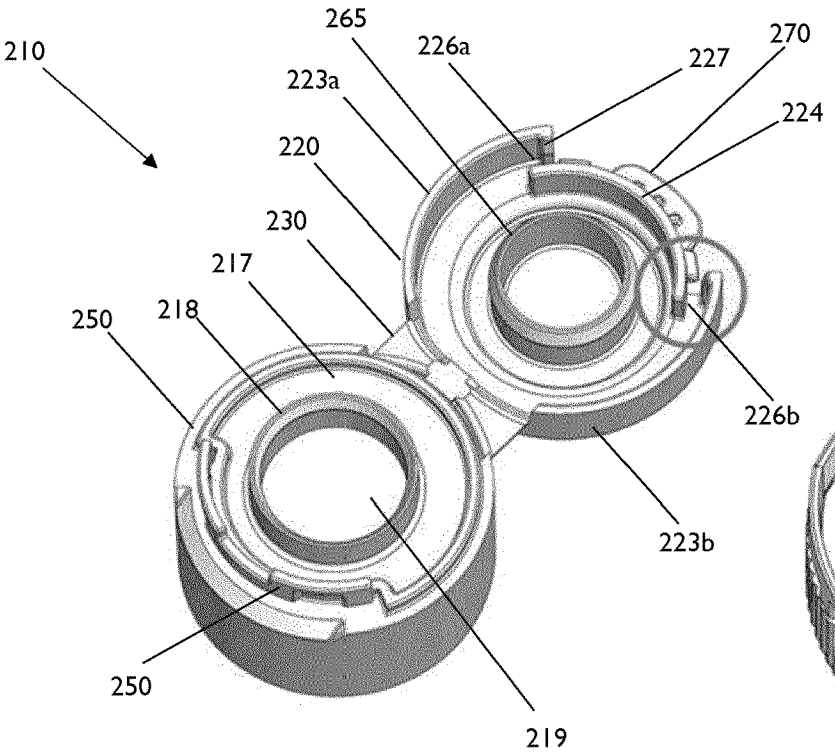
FIG. 14 is a perspective view of a closure formed according to a further embodiment and shown in an as-moulded condition.
Figure 16:
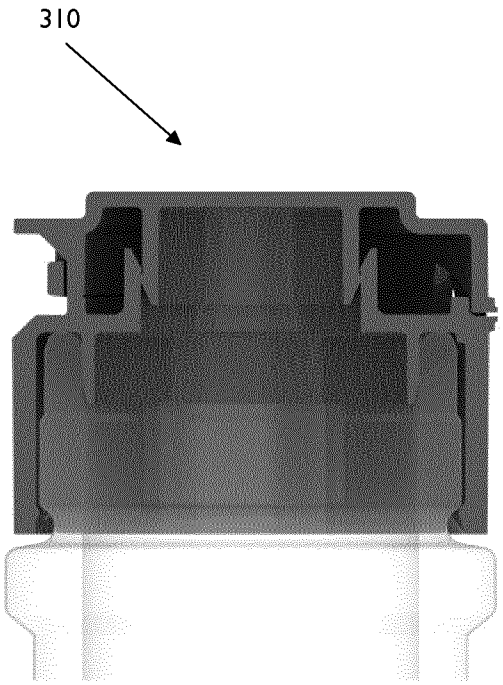
FIG. 16 is a section of the closure of FIG. 15 and shown connected to a container neck.
Figure 15:
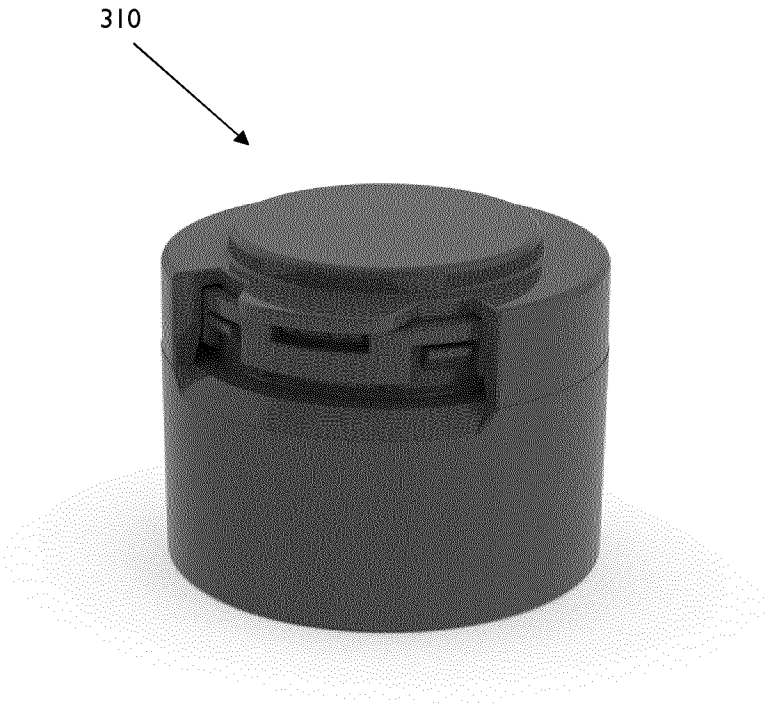
FIG. 15 is a front perspective view of a closure formed according to a further embodiment and shown in an initially closed position/condition.
Figure 18:
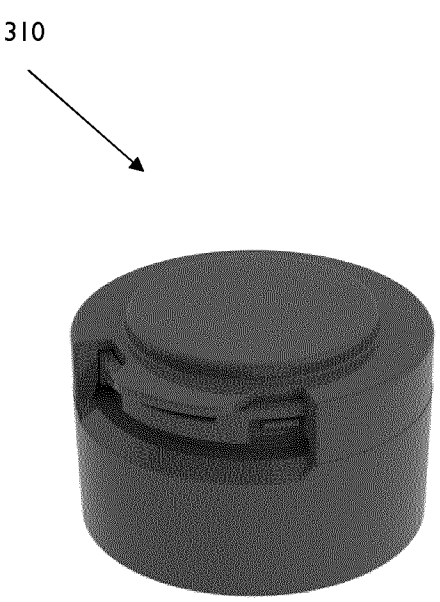
FIG. 18 shows the closure of FIG. 17 in an initially closed position (prior to first opening)
Figure 17:
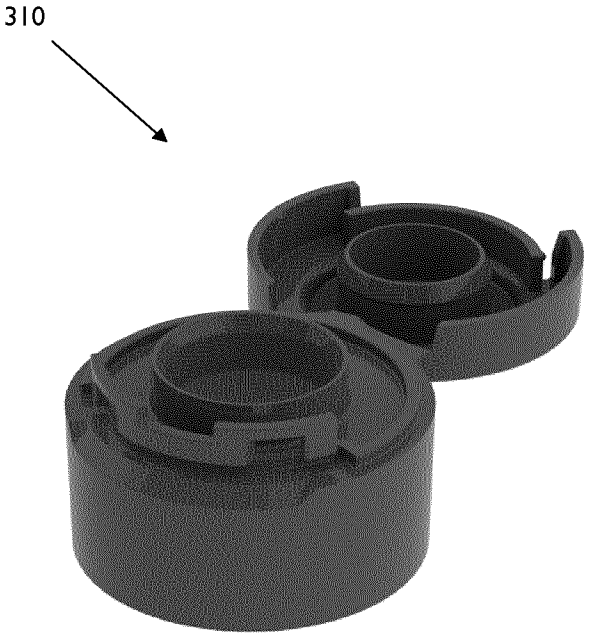
FIG. 17 is a front perspective view of the closure of FIGS. 15 and 16 and shown in an as-moulded condition.
Figure 20:
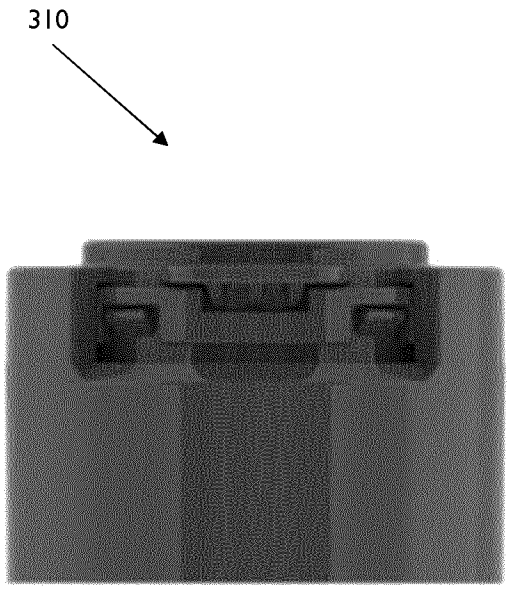
FIG. 20 is a front elevation of the closure of FIG. 19.
Figure 19:
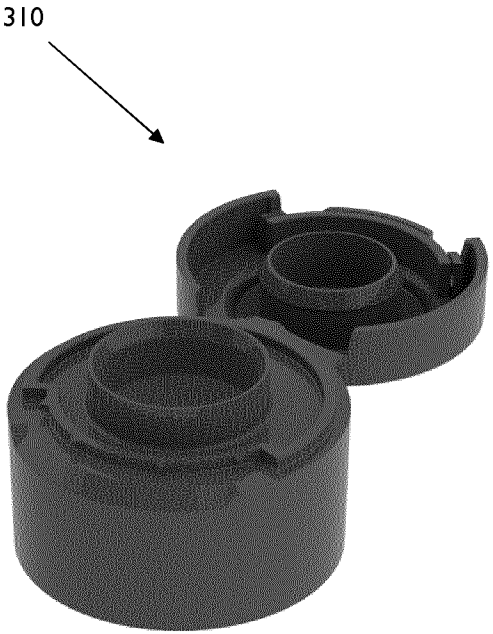
FIG. 19 shows the closure of FIG. 17 after first opening.
Figure 21:
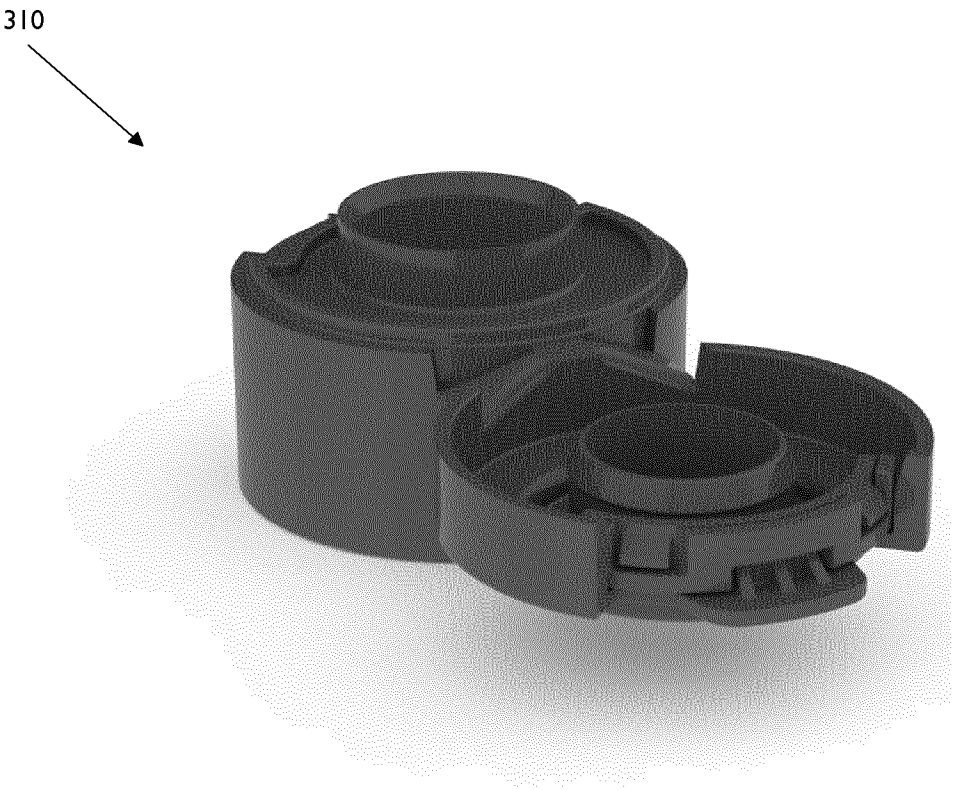
FIG. 21 is a rear perspective view of the closure of FIGS. 19 and 20, showing a tamper-evident strip retained by a lid.
Figure 25:
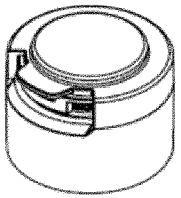
FIGS. 22 to 27 show the following views of a closure formed according to a further embodiment: front; plan; sectional (along line A-A); front perspective (unopened); front perspective (opened); front perspective (as moulded).
Figure 26:
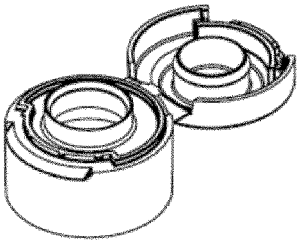
Figure 27:
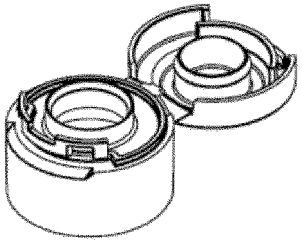
Figure 24:
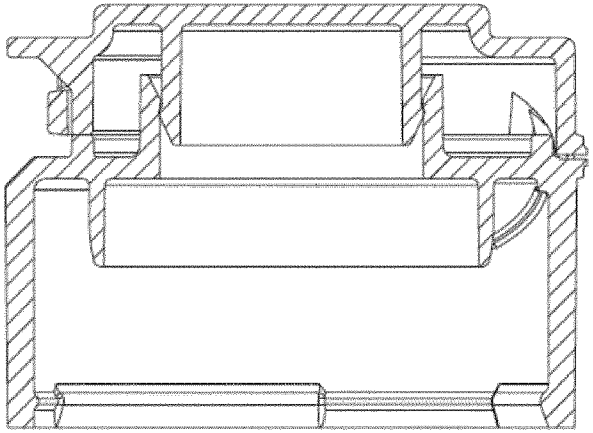
Figure 23:
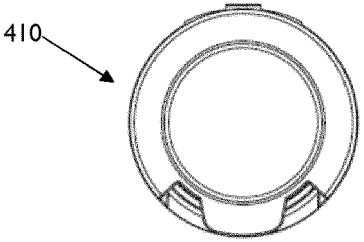
Figure 22:
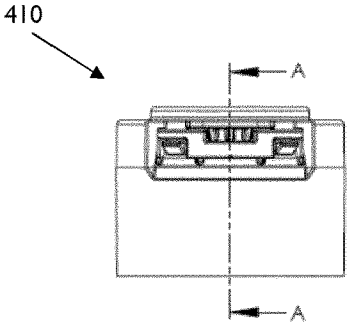

FIG. 14 illustrates a closure 210 formed according to a further embodiment and shown in an as-moulded condition.

The lid skirt 222 comprises two arcuate wall sections 223*a*, 223*b* which extend from the hinge region 230. A recessed wall section 224 is provided, but in this embodiment the section 224 is not joined to the wall sections 223*a*, 223*b*, meaning that "open" pockets 226*a*, 226*b* are formed. Each of the arcuate wall sections 223*a*, 223*b* terminate with retention beads 227.

An annular sealing plug 265 depends from the underside of the lid top plate for sealing the spout 219.

A peak 270 extends from the front of the lid to assist with lifting the lid in use.

FIGS. 15 to 21 show a closure 310 formed according to a further embodiment, similar to the closure 210.

FIGS. 22 to 27 show a closure 410 formed according to a further embodiment, similar to the closures 210, 310.

Although illustrative embodiments of the invention have been disclosed in detail herein, with reference to the accompanying drawings, it is understood that the invention is not limited to the precise embodiments shown and that various changes and modifications can be effected therein by one skilled in the art without departing from the scope of the invention as defined by the appended claims and their equivalents.

The invention claimed is:

1. A tamper-evident closure comprising a base and a lid joined by a hinge so that the lid is movable between a closed and an open position with respect to the base, the closure comprises a tamper-evident member which is initially provided on or by the base with the closure in an unopened condition, in which the tamper-evident member is released from the base when the lid is initially moved to the open position and is then retained by the lid, in which the lid includes pockets for retaining the tamper-evident member, in which the pockets include a bead to help retain the tamper-evident member after first opening, and in which the tamper-evident member includes retention beads that correspond with the beads of the pockets.

2. A closure as claimed in claim 1, in which the tamper-evident member is frangibly connected to the base and is configured to break away from the base upon first opening.

3. A closure as claimed in claim 1, in which each pocket is formed by an overhang.

4. A closure as claimed in claim 1, in which each pocket is formed by an extension of a lid sidewall.

5. A closure as claimed in claim 1, in which the pockets are closed-ended.

6. A closure as claimed in claim 1, in which the pockets are open-ended.

7. A closure as claimed in claim 6, in which the lid includes a lid skirt that comprises two arcuate wall sections which extend from the region of the hinge, and a recessed wall section is provided, the recessed wall section is not joined to the arcuate wall sections, meaning that open pockets are formed, and each of the arcuate wall sections terminate with retention beads.

8. A closure as claimed in claim 1, in which the tamper-evident member comprises one or more cut-out portions.

9. A closure as claimed in claim 1, in which the lid comprises one or more lifting projections which lift the tamper-evident member away from the base when the lid is initially opened.

10. A closure as claimed in claim 9, in which the lifting projections are positioned in a recessed zone.

11. A closure as claimed in claim 10, in which the recessed zone is located at the front of the closure.

12. A closure as claimed in claim 1, in which the tamper-evident member is a tamper-evident strip.

13. A closure as claimed in claim 1, in which the base comprises a top deck and a dispensing orifice is provided in the deck.

14. A tamper-evident closure comprising a base and a lid joined together by a hinge so that the lid can move between closed position and an open position, the base comprises a cylindrical sidewall closed at one end by a top deck, at the centre of the top deck a dispensing spout is provided to define a dispensing orifice, the lid comprises a circular top plate at the periphery of which is a depending cylindrical skirt, inner and outer sealing skirts depend from the underside of the lid top plate for sealing the spout, the skirt comprises two arcuate wall sections which extend from the hinge region, the wall sections are joined by an arcuate recessed wall section which extends around the front of the closure, opposite the hinge, the wall sections continue, circumferentially, beyond the ends of the recessed wall section, forming wall extension portions that define pockets or slots, the interior of the wall extension portions are provided with an axial bead or rib, an arcuate tamper-evident strip is provided at a front of the closure, the strip is frangibly connected to the top of the periphery of the base by one or more frangible bridges, the recessed wall section of the lid is provided with two wedge-like projections, the projections include an inclined lower surface and a flat upper surface, the strip is provided with two notches which correspond with the projections, the ends of the strip fit into respective lid pockets, in which the flat upper surfaces prevent the lid from being lifted without lifting the strip, breaking the strip away from the base, and in which the strip is retained by the lid by virtue of the engagement of the strip ends in the lid pockets in combination with the engagement of the lid projections under the strip notches.

15. A closure as claimed in claim 14, in which the strip ends are provided with retention beads that correspond with the extension portion beads.

16. A closure as claimed in claim 14, in which the closure base is formed so as to be snap-on, having an internal snap bead for engaging a corresponding bead on a container.

17. A tamper-evident closure comprising a base and a lid joined by a hinge so that the lid is movable between a closed and an open position with respect to the base, the closure comprises a tamper-evident member which is initially provided on or by the base with the closure in an unopened condition, in which the tamper-evident member is released from the base when the lid is initially moved to the open position and is then retained by the lid, in which the lid includes pockets for retaining the tamper-evident member, in which the pockets include a bead to help retain the tamper-evident member after first opening, in which the pockets are open-ended, and in which the lid includes a lid skirt that comprises two arcuate wall sections which extend from the region of the hinge, and a recessed wall section is provided, the recessed wall section is not joined to the arcuate wall sections, meaning that open pockets are formed, and each of the arcuate wall sections terminate with retention beads.

18. A tamper-evident closure comprising a base and a lid joined by a hinge so that the lid is movable between a closed and an open position with respect to the base, the closure comprises a tamper-evident member which is initially provided on or by the base with the closure in an unopened condition, in which the tamper-evident member is released from the base when the lid is initially moved to the open position and is then retained by the lid, in which the lid includes pockets for retaining the tamper-evident member, in which the pockets include a bead to help retain the tamper-evident member after first opening, in which the lid comprises one or more lifting projections which lift the tamper-evident member away from the base when the lid is initially opened and in which the lifting projections are positioned in a recessed zone.

* * * * *